US010119313B2

(12) United States Patent
Higgins et al.

(10) Patent No.: US 10,119,313 B2
(45) Date of Patent: Nov. 6, 2018

(54) TAILGATE LOCK SYSTEM

(71) Applicant: McGard LLC, Orchard Park, NY (US)

(72) Inventors: Nicholas J. Higgins, Hamburg, NY (US); Raymond A. Murray, Hamburg, NY (US); David C. Meyer, Boston, NY (US); Andrew D. Trank, Orchard Park, NY (US)

(73) Assignee: McGard LLC, Orchard Park, NY (US)

( * ) Notice: Subject to any disclaimer, the term of this patent is extended or adjusted under 35 U.S.C. 154(b) by 201 days.

(21) Appl. No.: 15/008,044

(22) Filed: Jan. 27, 2016

(65) Prior Publication Data

US 2016/0222708 A1 Aug. 4, 2016

Related U.S. Application Data

(60) Provisional application No. 62/110,165, filed on Jan. 30, 2015.

(51) Int. Cl.
*E05D 11/00* (2006.01)

(52) U.S. Cl.
CPC ..... *E05D 11/0018* (2013.01); *E05Y 2900/516* (2013.01); *E05Y 2900/546* (2013.01); *E05Y 2900/548* (2013.01)

(58) Field of Classification Search
CPC .. B62D 33/0273; B62D 33/037; B60R 25/00; B60R 25/001
See application file for complete search history.

(56) References Cited

U.S. PATENT DOCUMENTS

| | | | | |
|---|---|---|---|---|
| 5,857,738 | A * | 1/1999 | Hamilton | B62D 33/0273 16/254 |
| 7,195,300 | B2 * | 3/2007 | Austin | B62D 33/0273 16/308 |
| 7,281,747 | B2 * | 10/2007 | Austin | B62D 33/0273 296/50 |
| 7,500,706 | B2 * | 3/2009 | Anderson | E05D 7/1072 296/50 |
| 8,418,512 | B2 * | 4/2013 | Trank | B60R 25/001 70/16 |
| 8,696,046 | B2 * | 4/2014 | Sackett | B62D 33/0273 296/50 |
| 8,707,745 | B2 * | 4/2014 | Kalous | B62D 33/037 280/507 |
| 2017/0274869 | A1 * | 9/2017 | Da Deppo | B62D 33/0273 |

* cited by examiner

*Primary Examiner* — Victor D Batson
*Assistant Examiner* — Matthew J Sullivan
(74) *Attorney, Agent, or Firm* — Harter Secrest & Emery LLP

(57) ABSTRACT

A tailgate lock system comprising a security lock for a tailgate hinge assembly, wherein the tailgate hinge assembly comprises a fixed cup portion and a rotating portion arranged to rotate about a hinge axis relative to the fixed cup portion, an adapter configured to extend between the security lock and the tailgate hinge assembly, the adapter having an inside surface having a first portion configured to engage the rotating portion of the hinge assembly and a second portion configured to radially overlap the fixed cup portion of the hinge assembly, whereby selective rotation about the hinge axis causes rotation of the adapter and the security lock about the hinge axis.

14 Claims, 5 Drawing Sheets

TAILGATE LOCK SYSTEM

TECHNICAL FIELD

The present disclosure relates generally to the field of clamping-type security locks for installation on removable tailgates of trucks and other vehicles.

BACKGROUND ART

By way of background, various types of clamping-type security locks have been used to secure removable tailgates on trucks and other vehicles. Such locks commonly include a band or other clamping element that clamps over a structure to be secured (such as a tailgate hinge cup). The clamping element is attached to a locking mechanism that can be opened in order to release the clamping element during lock installation, and which can thereafter be closed to capture the clamping element so that it cannot be removed from the structure on which the lock is installed U.S. Pat. No. 8,418,512, which issued Apr. 16, 2013 and is entitled "Universal Adjustable Security Lock for Truck Tailgates and Other Clamping Applications," is directed to a security lock for clamping a structure that includes a lock housing having a barrel portion that supports an adjustable band-type clamp. The clamp is adjustable using a lock screw that rotates in the housing. The disclosure of U.S. Pat. No. 8,418,512 is hereby incorporated by reference in its entirety.

BRIEF SUMMARY OF THE INVENTION

With parenthetical reference to corresponding parts, portions or surfaces of the disclosed embodiment, merely for the purposes of illustration and not by way of limitation, the present disclosure provides an improved tailgate lock system (15) comprising a security lock (2) for a tailgate hinge assembly (18), wherein the tailgate hinge assembly comprises a fixed cup portion (19) and a rotating portion (21, 22) configured and arranged to rotate about a hinge axis (x-x) relative to the fixed cup portion, an adapter (16) configured and arranged to extend between the security lock and the tailgate hinge assembly, the adapter having an inside surface (28, 30) and an outside surface (24), the inside surface of the adapter having a first portion (30*a*, 30*b*) configured to engage the rotating portion of the hinge assembly and a second portion (28) configured to radially overlap the fixed cup portion of the hinge assembly, whereby selective rotation about the hinge axis causes rotation of the adapter and the security lock about the hinge axis.

The fixed cup portion of the hinge assembly may comprise an outer surface (56) having a taper (38) relative to the hinge axis and the second portion (28) of the inside surface of the adapter may comprise a taper (39) relative to the hinge axis corresponding to the taper of the outer surface of the fixed cup portion. The rotating portion of the hinge assembly may comprise an outer surface (40*a*, 40*b*) substantially parallel to the hinge axis and the first portion (30*a*, 30*b*) of the inside surface of the adapter may be substantially parallel to the hinge axis. The outer surface of the rotating portion of the hinge assembly may comprise a first flat surface (40*a*) and a second flat surface (40*b*) and the first portion of the inside surface of the adapter may comprise a first flat surface (30*a*) and a second flat surface (30*b*) configured to engage the first flat surface (40*a*) and the second flat surface (40*b*) of the outer surface of the rotating portion of the hinge assembly, respectively.

The adapter may comprise a hinge receiving slot (33) extending longitudinally relative to the hinge axis. The rotating portion of the hinge assembly may have a rotatable cup width (42) about the hinge axis and the slot in the adapter may have an adapter slot width (43) greater than the rotatable cup width of the rotating portion. The fixed cup portion (19) of the hinge assembly may comprise a hinge receiving slot (37) extending longitudinally relative to the hinge axis and the slot of the fixed cup portion may have a fixed cup slot width (44) greater than the rotatable cup width of the rotating portion. The rotating portion of the hinge assembly may comprise a shaft member (21) and a inner rotatable cup (22) configured and arranged to receive the shaft member, whereby selective rotation of the inner rotatable cup about the hinge axis causes rotation of the shaft member about the hinge axis. The inner rotatable cup of the rotating portion of the hinge assembly may comprise a shaft receiving slot (41) extending longitudinally relative to the hinge axis, the shaft member of the rotating portion of the hinge assembly may have a shaft width (45) about the hinge axis, and the slot in the inner rotatable cup may have a rotatable cup slot width (46) greater than the shaft width of the shaft member. The adapter may comprise an adapter hinge receiving slot (33) extending longitudinally relative to the hinge axis, the inner rotatable cup of the rotating portion of the hinge assembly may have a rotatable cup width (42) about the hinge axis, and the slot in the adapter may have an adapter slot width (43) greater than the rotatable cup width of the inner rotatable cup of the rotating portion. The fixed cup portion of the hinge assembly may comprise a fixed hinge receiving slot (37) extending longitudinally relative to the hinge axis and the slot of the fixed cup portion may have a fixed cup slot width (44) greater than the rotatable cup width of the inner rotatable cup of the rotating portion. The security lock may comprise a lock housing (4) and an adjustable clamp band (8) and the adapter may be configured and arranged to extend between the clamp band and the tailgate hinge assembly. The adjustable clamp band may be configured and arranged to apply an inwardly-directed radial clamping force relative to said hinge axis. The fixed cup portion of the hinge assembly may comprise a fixed hinge receiving slot (37) and the security lock may be configured and arranged to circumferentially span the fixed hinge receiving slot.

DETAILED DESCRIPTION OF EXAMPLE EMBODIMENT

Figure 1:
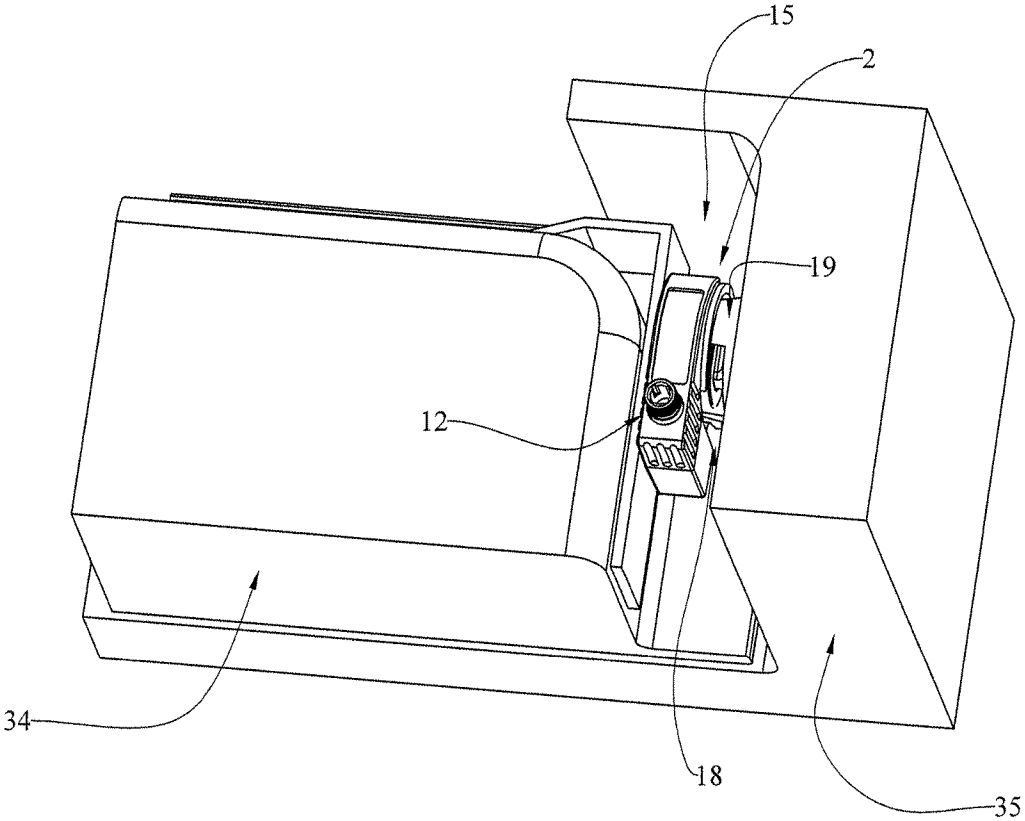
FIG. 1 is a perspective view of a first embodiment of an improved tailgate lock system, installed on a tailgate in an open position.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
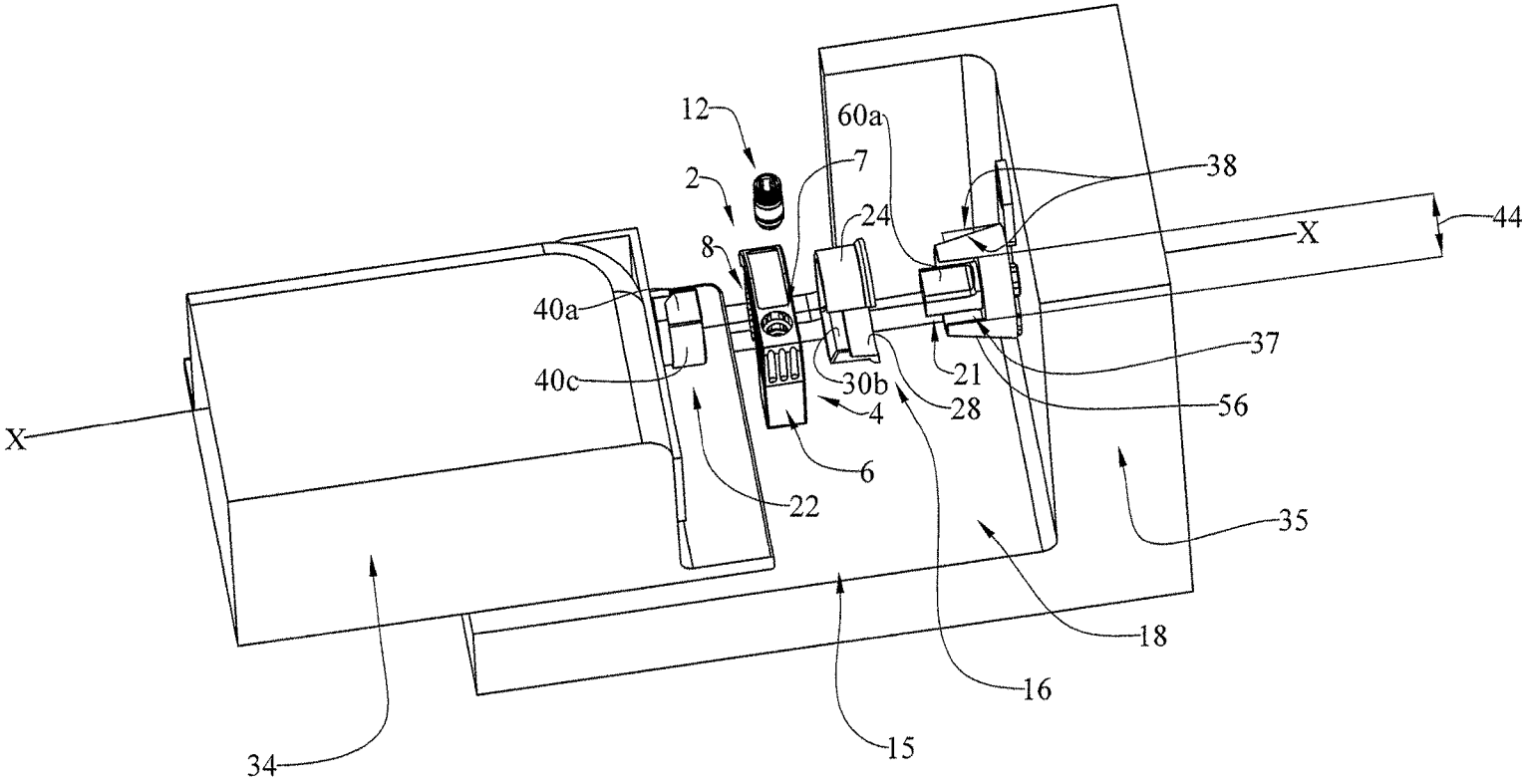
FIG. 2 is an exploded view of the tailgate lock system shown in FIG. 1.
Figure 4:
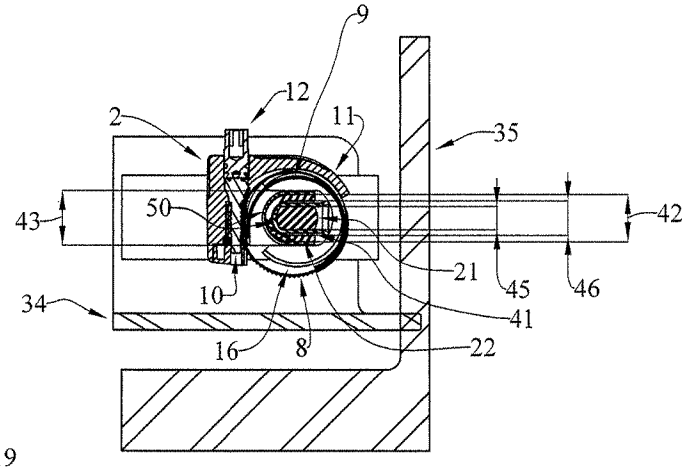
FIG. 4 is a vertical transverse cross-sectional view of the tailgate lock system shown in FIG. 3, taken generally on line A-A of FIG. 3.
Figure 3:
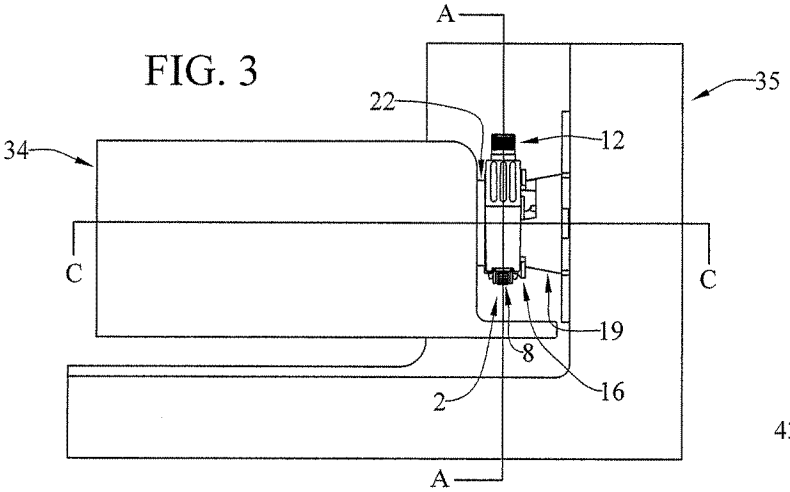
FIG. 3 is a front side elevation view of the tailgate lock system shown in FIG. 1.
Figure 5:
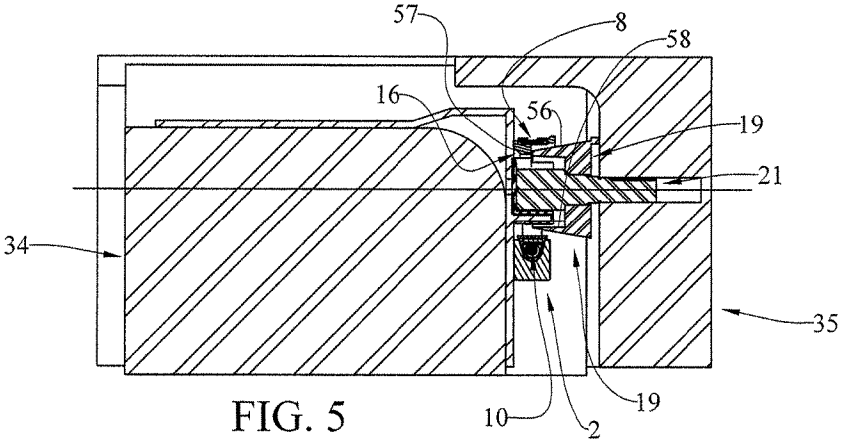
FIG. 5 is a horizontal longitudinal cross-sectional view of the tailgate lock system shown in FIG. 3, taken generally on line C-C of FIG. 3.
Figure 7:
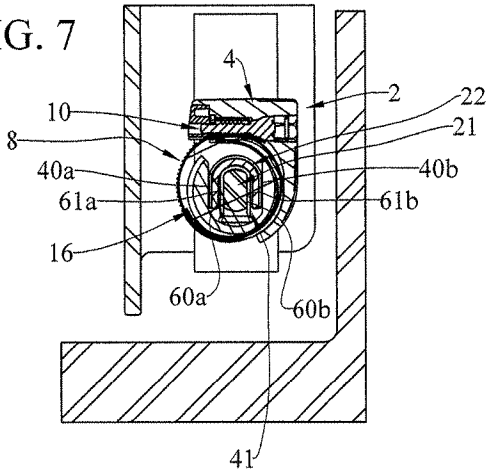
FIG. 7 is a vertical transverse cross-sectional view of the tailgate lock system shown in FIG. 6, taken generally on line A-A of FIG. 6.
Figure 6:
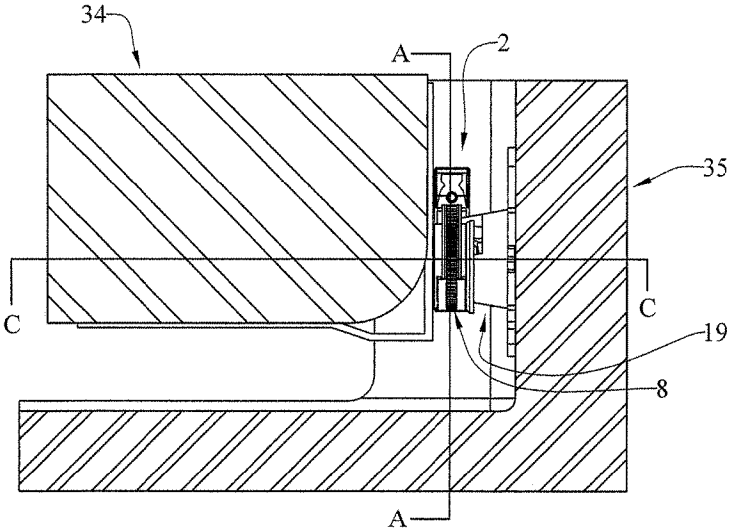
FIG. 6 is a front side view of the tailgate lock system shown in FIG. 1 with the tailgate in a closed position.
Figure 8:
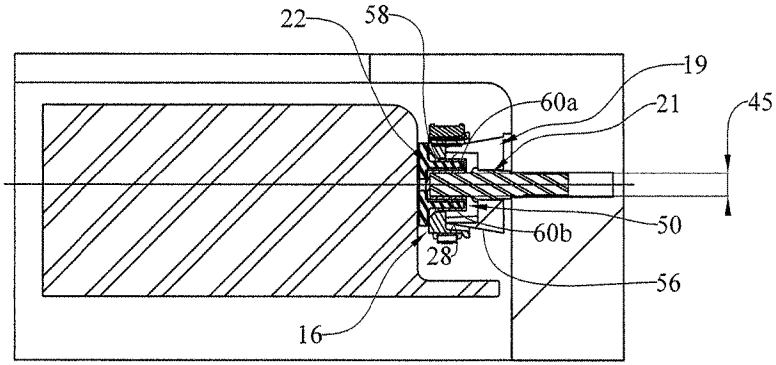
FIG. 8 is a horizontal longitudinal cross-sectional view of the tailgate lock system shown in FIG. 6, taken generally on line C-C of FIG. 6.

Referring now to the drawings, and more particularly to FIGS. 1-2 thereof, an improved tailgate lock system is provided, of which a first embodiment is generally indicated at 15. As shown, tailgate lock system 15 generally includes security lock 2 and adapter 16. As shown, tailgate lock system 15 is installed on the hinge assembly 18 between tailgate 34 and truck bed or truck box 35 of a vehicle.

As shown in FIGS. 2-8, hinge assembly 18 generally comprises fixed cup 19, which extends from and is fixed to a vertical edge of tail bed 35, and a rotating portion, which is configured to rotate relative to fixed cup 19 and tail bed 35. In this embodiment, the rotating portion comprises hinge pin 21, which is rotatable about axis x-x relative to fixed cup 19, and inner rotatable cup 22, which extends from and is fixed to the vertical edge of tailgate 34, such that rotation of tailgate 34 causes rotation of inner rotatable cup 22 and hinge pin 21 therewith. While this embodiment includes hinge pin 21, it is contemplated that other hinge configurations may be used. For example, and without limitation, the hinge assembly may not include a hinge pin extending from inside fixed cup 19 and the inner rotatable cup may not include a slot or may be a shaft that rotates inside fixed cup 19.

As shown, inner rotatable cup 22 is a generally U-shaped member elongated along x-x having two outer parallel flat planar surfaces 40*a* and 40*b* and outer curved surface 40*c*. As shown, cup 22 includes slot 41 having width 46 perpendicular to hinge axis x-x and configured and arranged to receive hinge pin 21 for rotation therewith relative to fixed cup 19 and truck bed 35. In FIGS. 3-8, inner rotatable cup 22 is shown as having an encapsulating liner 50, which covers both the inside and outside surfaces of inner rotatable cup to reduce abrasion between inner rotatable cup 22 and pin 45 and fixed cup 19, respectively.

As shown, in this embodiment hinge pin 21 is an obround shaped member having two parallel planar surfaces 60*a* and 60*b* separated by width 45. Width 45 of outer surfaces 60*a* and 60*b* of hinge pin 21 is slightly less than inner width 46 between inner facing parallel surfaces 61*a* and 61*b* of slot 41 of inner rotatable cup 22. Accordingly, when properly aligned with inner rotatable cup 22, pin 21 slides through slot 41 of inner rotatable cup 22 and straddles the opposed parallel outer surfaces 60*a* and 60*b* of rotatable hinge pin 21. Thus, cup 21 is fixed relative to tailgate 34 but rotates with pin 21 relative to fixed cup 19 and tail bed 35.

As shown, fixed cup 19 has a leftwardly and outwardly-facing frusto-conical tapered surface 56, an inwardly-facing horizontal cylindrical surface 58 and a leftwardly-facing vertical surface 57. Slot 37 is formed in cup 19 and has a width 44 perpendicular to hinge axis x-x. Slot 37 is configured to receive inner rotatable cup 22. Accordingly, when properly aligned with fixed cup 19, inner rotatable cup 22 slides through slot 37 of fixed cup 19 and straddles pin 21. Outer frusto-conical surface 56 of cup 19 is tapered at angle 38 relative to axis x-x. While this embodiment includes tapered outer surface 56, this outer surface may not be tapered and it is contemplated that other configurations may be used. For example, and without limitation, the outer surface of the fixed cup may be an outwardly-facing horizontal cylindrical surface.

Figure 10:
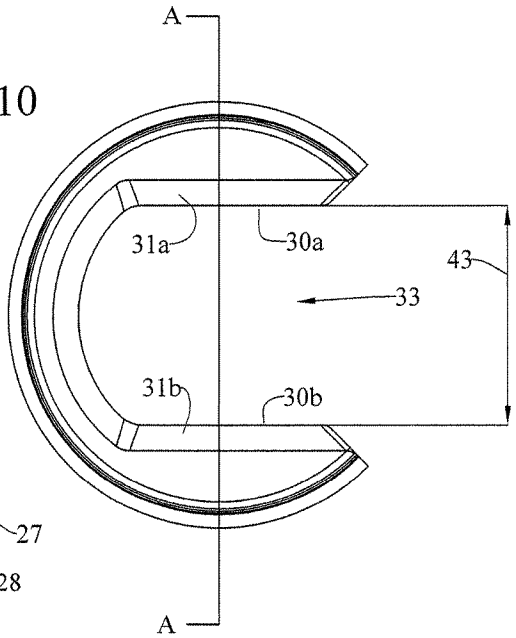
FIG. 10 is a top plan view of the adapter shown in FIG. 9.
Figure 11:
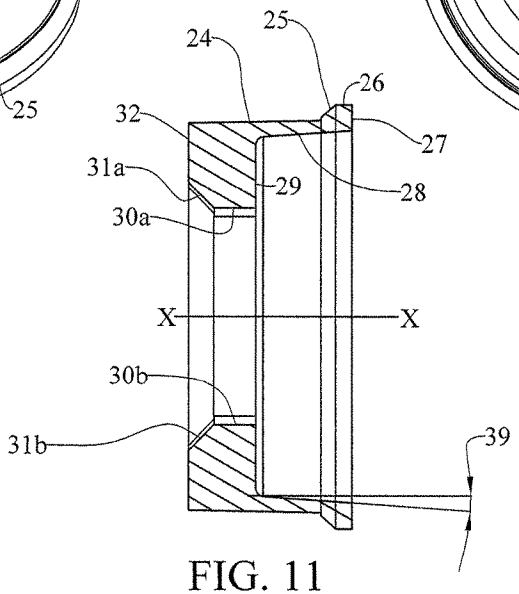
FIG. 11 is a vertical cross-section view of the adapter shown in FIG. 10, taken generally on line A-A of FIG. 10.
Figure 9:
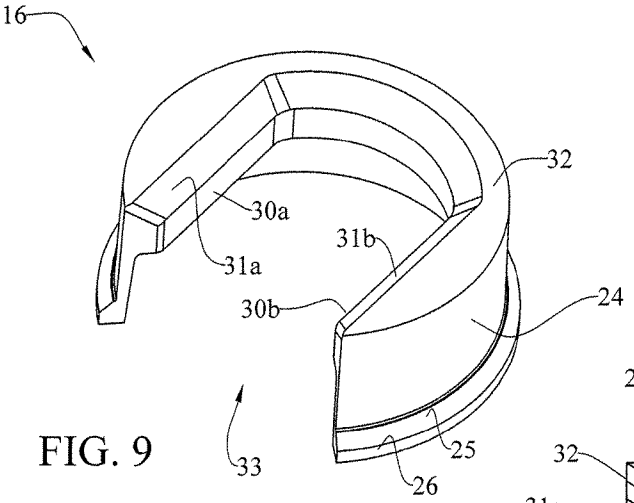
FIG. 9 is a perspective view of the adapter shown in FIG. 2.

As shown in FIG. 2, tailgate lock system 15 generally comprises adapter 16 and security lock 2. As shown in FIGS. 9-11, adapter 16 is a generally cylindrical member having a circumferential section removed to form slot 33. As shown in FIG. 10, slot 33 has a width 43 between parallel surfaces 30*a* and 30*b*. As shown in FIG. 11, adapter 16 is generally defined by outwardly-facing horizontal cylindrical surface 24, leftwardly and outwardly-facing frusto-conical surface 25, outwardly-facing horizontally cylindrical surface 26, rightwardly-facing vertical annular surface 27, rightwardly and inwardly-facing slightly frusto-conical surface 28, rightwardly-facing vertical annular surface 29, inwardly-facing horizontal parallel planar surfaces 30*a* and 30*b*, inwardly and leftwardly-facing frusto-conical surfaces 31*a* and 31*b*, and leftwardly-facing vertical surface 32, joined at its outer marginal end to the left marginal end of surface 24. Opposed parallel surfaces 30*a* and 30*b* define slot 33 and are separated by width 43.

Adapter 16 is configured to radially overlap at least a portion of outer surface 56 of fixed cup 19 when rightwardly-facing vertical annular surface 29 abuts against leftwardly-facing annular vertical surface 57 of fixed cup 19. Inner parallel surfaces 30*a* and 30*b* are configured to bear against outer parallel surfaces 40*a* and 40*b* of inner rotatable cup 22. Inner surface 28 of adapter 16 is tapered at angle 39 relative to axis x-x such that taper 39 is substantially the same or more than taper angle 38 of outer surface 56 of fixed cup 19 and such that a portion of surface 28 radially overlaps a portion of outer surface 56 of fixed cup 19 by some amount when positioned in place. Slot 33 has a width 43 that is slightly larger than width 42 of inner rotatable cup 22 so that inner rotatable cup 22 slides through both slot 33 in adapter 16 as well as slot 37 in fixed cup 19 to straddle pin 21. While this embodiment includes a tapered inner surface 28, this outer surface may not be tapered and it is contemplated that other configurations may be used. For example, and without limitation, the inner surface of the overlapping portion of adapter 16 may be an inwardly-facing horizontal cylindrical surface.

As shown in FIGS. 2-8, in this embodiment security lock 2 includes lock housing 4 having barrel portion 6 that mounts adjustable band-type clamp 8. Bore 7 is formed in housing barrel 6. Clamp band 8 is configured to wrap around the assembly to be locked. A free end of clamp band 8 is insertable into lock housing 4. Clamp 8 is adjustable using a lock screw 10 that is rotatable in bore 7 of housing barrel 6. When the free end of clamp band 8 is inserted into a small gap between the shank of lock screw 10 and the side of the clamp base, the threads will adjustably engage a ridged thread pattern on clamp band 8 that extends from the clamp band free end. Rotation of lock screw 10 in a clockwise direction pulls the free end of the clamp band 8 into housing 4 and increases its overlap with the clamp base, thereby tightening security lock 2 on the assembly to be secured. Conversely, rotating lock screw in a counterclockwise direction pushes the free end of the clamp band 8 in the opposite direction and decreases its overlap of the clamp base end, thereby loosening security lock 2.

The head of lock screw 10 has a circular sidewall and is recessed within the entrance of bore 7. Bore 7 is sized so that there is minimal clearance between the screw head and the sidewall of bore 7. The exposed face of the screw head is generally planar and configured with a security lock pattern that may be formed as a continuous curvilinear groove (or other formation) in the generally planar surface. Security key 12 with a matching curvilinear ridge pattern (or other formation) may be used to engage the security lock pattern to rotate lock screw 10. This arrangement is designed to prevent unauthorized removal of security lock 2. Other key-lock interface configurations could also be used.

A flexible lock liner may be provided on lock housing 4. Lock liner 9 extends along the inside of the clamp band 8 for a selected distance. Lock liner 9 may begin at or near the clamp base and extend toward the free end of clamp band 8. When security lock 2 is installed on hinge assembly 18, lock liner 9 is disposed between clamp band 8 and adapter 16.

Lock housing 4 may be provided with curved rigid arm 11 that extends from barrel 6 of lock housing 4 and follows a portion of clamp band 8. Rigid arm 11 may have a channel that receives clamp band 8 and helps stabilize it against lateral movement. Rigid arm 11 may extend for a desired distance to cover a desired portion of the clamp band 8, such as the portion that would be otherwise exposed following installation of security lock 2 on hinge assembly 18. In this way, rigid arm 11 helps protect clamp band 8 against tampering using an unauthorized tool, such as a pry bar or a hacksaw.

Inner rotatable cup 22 is rotationally coupled to tailgate hinge pin 21, which extends from fixed cup 19 on the left or right vertical rear side of a vehicle truck bed. As pickup truck and SUV owners will appreciate, inner rotatable cup 22 of tailgate 34 is designed to be removed from rotatable pin 21 and fixed cup 19 of truck bed 35 so that tailgate 34 can be removed. A slot 37 that is at least as wide 44 as the outside diameter or width 46 of inner rotatable cup 22 is provided in fixed cup 19 for this purpose. Adapter 16 is positioned over fixed cup 19. Slot 33, which is at least as wide 43 as the outside diameter or width 46 of inner rotatable cup 22, is provided in adapter 16 so inner rotatable cup 22 can engage hinge pin 21. Adapter 16 is disposed between clamp band 8 and inner rotating cup 22. Security lock 2 is secured so that clamp band 8 will wrap tightly around adapter 16. Security lock 2 prevents tailgate removal by virtue of clamp band 8 covering slot 37, such that inner rotatable cup 22 can no longer be removed from hinge pin 21 and fixed cup 19 unless security lock 2 is removed. While in embodiment security lock 2 comprises a housing and an adjustable band, it should be understood that other types and configurations of a security lock may be used. The security lock may be any configuration that closes the opening of slot 37 or otherwise prevents removal of the tailgate portion of the hinge assembly.

To install lock 2 in this embodiment, security key 12 is inserted into bore 7 in housing barrel 6. The security key 12 is manipulated so that its key pattern engages the lock pattern formed at the head of lock screw 10. The security key 12 is then turned counterclockwise until the free end of clamp band 8 is separated from the clamp base and freed from lock housing 4. The circumference of surface 24 of adapter 16 is measured to verify if lock liner 9 needs to be trimmed prior to security lock installation. Lock liner 9 may then be reinstalled on clamp band 8 by inserting the free end thereof into lock liner channel and sliding the lock liner along the clamp band until the lock liner lies generally against clamp band 8. Safety lock 2 is positioned such that clamp band 8 extends around and clamps against outer cylindrical surface 24 of adapter 16. The free end of clamp band 8 is inserted into the lock housing 4. The clamp band free end may then be advanced until it enters the small gap between the shank of lock screw 10 and the second side of the clamp base, and so that the threads of lock screw 10 adjustably engage the clamp band's ridged thread pattern. While holding clamp band 8, the security key 12 may be rotated several turns in the clockwise direction to start the engagement.

Then, using a suitable drive tool (e.g., a square drive attached to a screw driver handle or a ratchet), security lock 12 is turned clockwise to continue advancement of clamp band 8 until the security lock 2 is tightened snugly on adapter 16 on inner rotatable cup 22. The security key 12 is removed and a plastic insert may be inserted into lock housing bore 7 to keep out dirt. This provides a tight fit on a variety of vehicles/tailgates/other structures while preventing the security lock 2 from rattling or damaging the finish on the vehicle or other structure. Security lock housing 4 also provides added protection against unauthorized removal due to the rigid arm 11 thereof.

When safety lock 2 is tightened, band 8 tightens against outer surface 24 of adapter 16 so that band 8 covers slot 37 of fixed cup 19 to thereby lock tailgate 34 rotationally to truck bed 35. Because both band 8 and surface 24 are substantially parallel to axis x-x, the inward radial force of clamp 8 is transferred radially inward from surface 24 of adapter 16 to parallel flat surfaces 30*a* and 30*b* and onto parallel flat surfaces 40*a* and 40*b* of inner rotatable cup 22. Thus, the parallel flats 30*a* and 30*b* of adapter 16 allow lock 2 to clamp securely to inner rotatable cup 22 and rotate with the rotation of tailgate 34 and tailgate pin 21. The slightly tapered surface 28 does not bear against the tapered outer surface 56 of fixed cup 19. Thus lock 2 is tightened to inner rotatable cup 22 and not to fixed cup 19. This tapered and cantilevered overhang between adapter 16 and fixed cup 19 provides an outer surface 24 to clamp band 8 to, while maintaining clearance between fixed cup 19 and lock 2. The cantilevered section of adapter 16, which has a variable thickness provided by taper 39 in the inner diameter of inner surface 28, matches the outer taper 38 of outer surface 56 of cup 19, which helps to reduce or eliminate friction between adapter 16 and fixed cup 19. This allows lock 2 to rotate around fixed cup 19 without binding or wearing away paint or other surface finishes. Furthermore, adapter 16 is provided with a thickness that is sized to fill the gap between tailgate 34 and fixed cup 19 on truck bed 35, which prevents lock 2 from sliding longitudinally along axis x-x and onto the gap. This improves lock security. Thus, by driving off of two flats 40*a* and 40*b* on inner rotatble cup 22, lock 2 can be clamped onto adapter 16 and will rotate with tailgate 34. Thus, the configuration allows adapter 16 and tailgate lock 2 to rotate freely around fixed cup 19 while maintaining security and allows for tailgate lock 2 to clamp to inner rotatable cup or post 22 and rotate with tailgate 34 itself. Selective rotation of inner rotatable cup 22 causes adapter 16 and security lock 2 to rotate about hinge axis x-x without interference from or interfering with fixed cup 19 and truck tailgate 34.

The present disclosure contemplates that many changes and modifications may be made. Therefore, while the presently-preferred form of the improved tailgate lock has been shown and described, and a number of alternatives discussed, persons skilled in this art will readily appreciate that various additional changes and modifications may be made without departing from the scope of the invention, as defined and differentiated by the following claims.

What is claimed is:

1. A tailgate lock system comprising:

a security lock for a tailgate hinge assembly, wherein said tailgate hinge assembly comprises a fixed cup portion and a rotating portion configured and arranged to rotate about a hinge axis relative to said fixed cup portion;

an adapter configured and arranged to extend between said security lock and said tailgate hinge assembly;

said adapter having an inside surface and an outside surface;

said outside surface of said adapter configured to engage said security lock such that rotation of said adapter about said hinge axis causes rotation of said security lock about said hinge axis;

said inside surface of said adapter having a first portion configured to engage said rotating portion of said hinge assembly such that rotation of said rotating portion of said hinge assembly about said hinge axis causes rotation of said adapter about said hinge axis; and said inside surface of said adapter having a second portion configured to radially overlap said fixed cup portion of said hinge assembly;

whereby selective rotation of said rotating portion of said hinge assembly about said hinge axis causes rotation of said adapter and said security lock about said hinge axis.

2. The tailgate lock system of claim 1, wherein said fixed cup portion of said hinge assembly comprises an outer surface having a taper relative to said hinge axis and said second portion of said inside surface of said adapter comprises a taper relative to said hinge axis corresponding to said taper of said outer surface of said fixed cup portion of said hinge assembly.

3. The tailgate lock system of claim 1, wherein said rotating portion of said hinge assembly comprises an outer surface substantially parallel to said hinge axis and said first portion of said inside surface of said adapter is substantially parallel to said hinge axis.

4. The tailgate lock system of claim 1, wherein said outer surface said rotating portion of said hinge assembly comprises a first flat surface and a second flat surface and said first portion of said inside surface of said adapter comprises a first flat surface and a second flat surface configured to engage said first flat surface and said second flat surface of said outer surface of said rotating portion of said hinge assembly, respectively.

5. The tailgate lock system of claim 1, wherein said adapter comprises an adapter hinge receiving slot extending longitudinally relative to said hinge axis.

6. The tailgate lock system of claim 5, wherein said rotating portion of said hinge assembly has a rotatable cup width about said hinge axis and said adapter hinge receiving slot in said adapter has an adapter slot width greater than said rotatable cup width of said rotating portion of said hinge assembly.

7. The tailgate lock system of claim 6, wherein said fixed cup portion of said hinge assembly comprises a fixed hinge receiving slot extending longitudinally relative to said hinge axis and said fixed hinge receiving slot of said fixed cup portion has a fixed cup slot width greater than said rotatable cup width of said rotating portion of said hinge assembly.

8. The tailgate lock system of claim 1, wherein said rotating portion of said hinge assembly comprises a shaft member and an inner rotatable cup configured and arranged to receive said shaft member, whereby selective rotation of said inner rotatable cup about said hinge axis causes rotation of said shaft member about said hinge axis.

9. The tailgate lock system of claim 8, wherein said inner rotatable cup of said rotating portion of said hinge assembly comprises a shaft receiving slot extending longitudinally relative to said hinge axis, said shaft member of said rotating portion of said hinge assembly has a shaft width about said hinge axis, and said shaft receiving slot in said inner rotatable cup has a rotatable cup slot width greater than said shaft width of said shaft member.

10. The tailgate lock system of claim 9, wherein said adapter comprises an adapter hinge receiving slot extending longitudinally relative to said hinge axis, said inner rotatable cup of said rotating portion of said hinge assembly has a rotatable cup width about said hinge axis, and said adapter hinge receiving slot in said adapter has an adapter slot width greater than said rotatable cup width of said inner rotatable cup of said rotating portion of said hinge assembly.

11. The tailgate lock system of claim 10, wherein said fixed cup portion of said hinge assembly comprises a fixed hinge receiving slot extending longitudinally relative to said hinge axis and said fixed hinge receiving slot of said fixed cup portion has a fixed cup slot width greater than said rotatable cup width of said inner rotatable cup of said rotating portion of said hinge assembly.

12. The tailgate lock system of claim 1, wherein said security lock comprises a lock housing and an adjustable clamp band and said adapter is configured and arranged to extend between said clamp band and said tailgate hinge assembly.

13. The tailgate lock system of claim 12, wherein said adjustable clamp band is configured and arranged to apply an inwardly-directed radial clamping force relative to said hinge axis.

14. The tailgate lock system of claim 1, wherein said fixed cup portion of said hinge assembly comprises a fixed hinge receiving slot and said security lock is configured and arranged to circumferentially span said fixed hinge receiving slot of said fixed cup portion of said hinge assembly.

* * * * *